US005904124A

United States Patent [19]

Poehlman et al.

[11] Patent Number: 5,904,124

[45] Date of Patent: May 18, 1999

[54] ENRICHMENT APPARATUS FOR INTERNAL COMBUSTION ENGINES

[75] Inventors: Arthur G. Poehlman, West Bend; Gary J. Gracyalny, Milwaukee; Robert K. Mitchell, Brookfield, all of Wis.

[73] Assignee: Briggs & Stratton Corporation, Wauwatosa, Wis.

[21] Appl. No.: 08/848,424

[22] Filed: May 8, 1997

[51] Int. Cl.[6] ..... F01L 13/08; F02M 1/10

[52] U.S. Cl. ..... 123/179.18; 123/182.1

[58] Field of Search ..... 123/179.16, 179.18, 123/182.1, 316

[56] References Cited

U.S. PATENT DOCUMENTS

| | | | |
|---|---|---|---|
| 3,620,203 | 11/1971 | Harkness | 123/182.1 |
| 3,735,745 | 5/1973 | Hatz | 123/182.1 |
| 4,414,933 | 11/1983 | Pribnow | 123/182.1 |
| 4,453,507 | 6/1984 | Braun et al. | 123/182.1 |
| 4,703,723 | 11/1987 | Tamba et al. | 123/182.1 |
| 4,892,068 | 1/1990 | Coughlin | 123/182.1 |
| 5,025,627 | 6/1991 | Schneider | 60/527 |
| 5,150,674 | 9/1992 | Gracyalny | 123/182.1 |
| 5,177,969 | 1/1993 | Schneider | 60/527 |
| 5,419,133 | 5/1995 | Schneider | 60/527 |
| 5,479,899 | 1/1996 | Phelps | 123/463 |
| 5,511,519 | 4/1996 | Watson et al. | 123/179.18 |

OTHER PUBLICATIONS

"Hoechst Celanese Polymers—Material Performance Data," published by Hoechst Celanese, Summit, New Jersey, at least as early as Apr., 1996.

"Technical Characteristics of FLEXINOL Actuator Wires," published by Dynalloy, Inc., Irvine, California at least as early as 1995.

Jang, B. Z. and Zhang, Z. J. "Thermally–and Phase Transformation–Induced Volume Changes of Polymers for Actuator Applications," *Proceedings of the Second International Conference on Intelligent Materials,* Jun. 1994, pp. 654–664.

Langnau, Leslie, "Hot Polymer Expands Actuator Technology," *Power Transmission Design,* Aug. 1995, pp. 31–32.

*Primary Examiner*—Andrew M. Dolinar
*Attorney, Agent, or Firm*—Michael Best & Friedrich LLP

[57] ABSTRACT

The automatic enrichment mechanism for an internal combustion engine is thermally-responsive and may also be centrifugally-responsive. The invention increases engine startability and minimizes stumbling and stalling of the engine during engine warmup. The thermally-responsive mechanism allows an additional reverse gas flow through the intake manifold to thereby increase the fuel discharged by the carburetor fuel nozzle. In several embodiments, the thermally-responsive mechanism, at low engine temperatures, causes a blocking or retaining member to keep an auxiliary cam member engaged with the cam follower of the valve assembly. As a result, the intake valve is partially unseated at low engine temperatures and a portion of the air/fuel mixture is fed back to the intake manifold. In these embodiments, when the engine temperature reaches a predetermined level, the thermally-responsive mechanism allows the auxiliary cam member to disengage from the cam follower in response to centrifugal force on the flyweights. In other embodiments, the thermally-responsive device allows crankcase gases to be fed to the intake manifold downstream of the fuel nozzle, causing a reverse flow of gas through the carburetor. The thermally-responsive member may be made from a thermal actuating polymer, commercial wax, bimetallic material, or from a nickel-titanium alloy which contracts at a predetermined engine temperature.

61 Claims, 7 Drawing Sheets

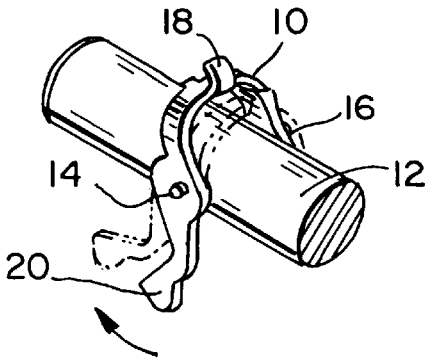
FIG. 1
PRIOR ART
FIG. 2
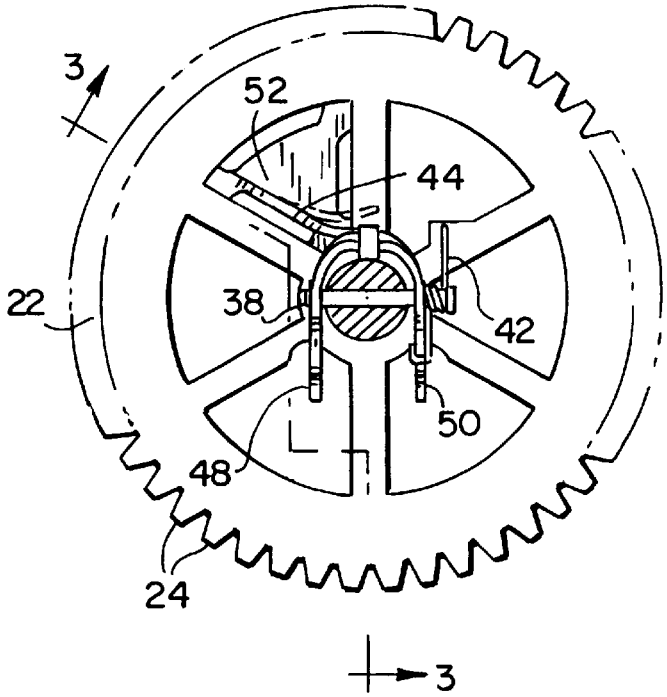
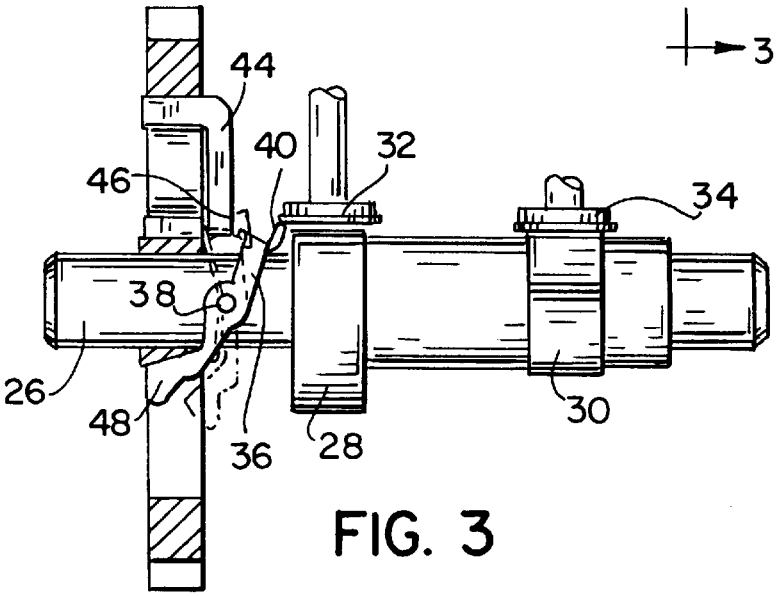
FIG. 3

FIG. 4
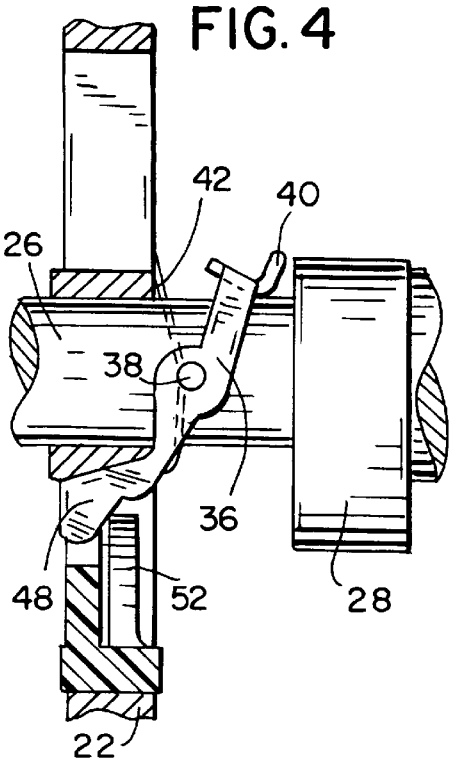
FIG. 5
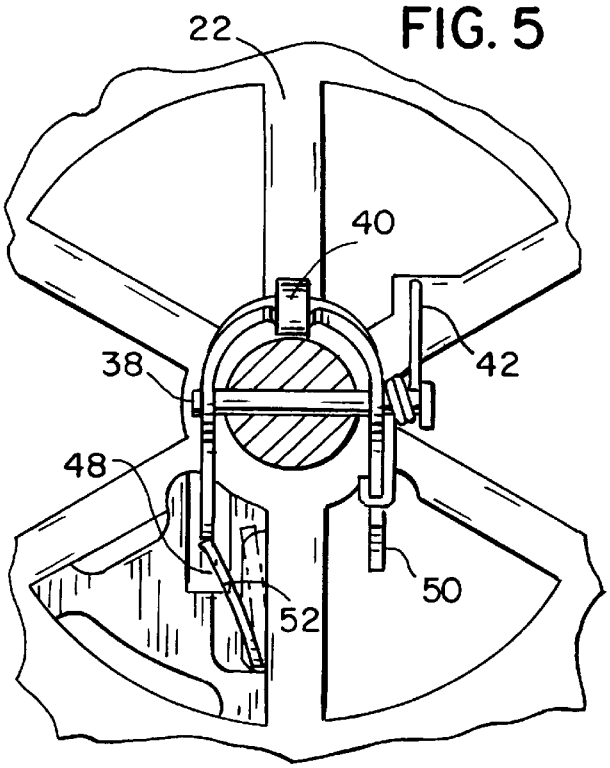
FIG. 6
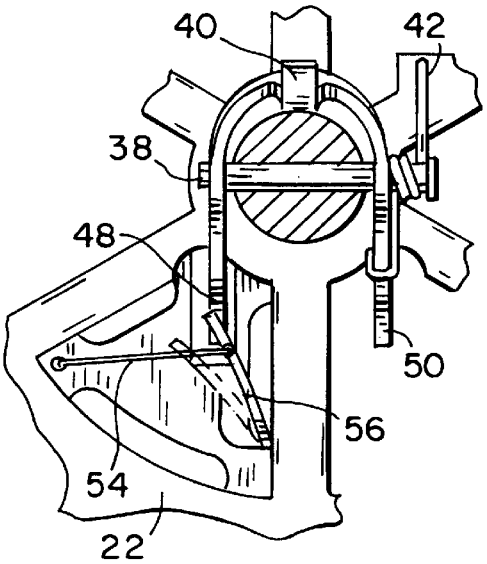
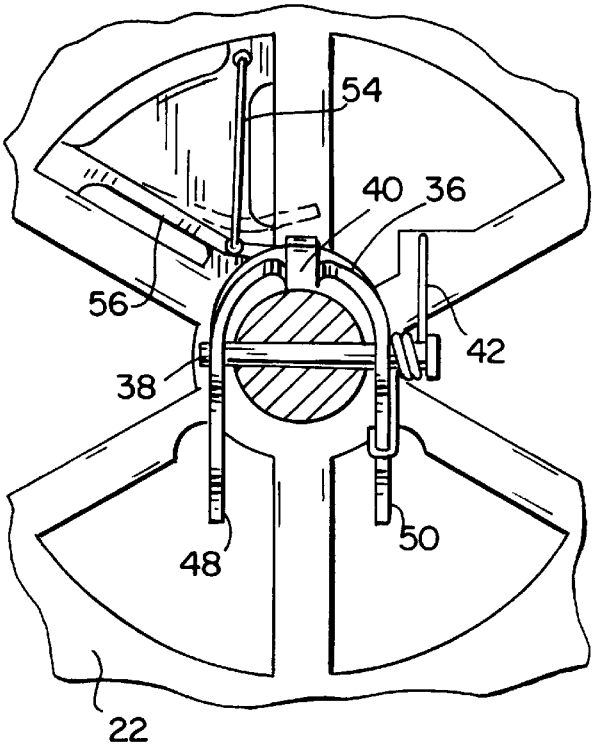
FIG. 7

ENRICHMENT APPARATUS FOR INTERNAL COMBUSTION ENGINES

BACKGROUND OF THE INVENTION

This invention relates to enrichment apparatus for an internal combustion engine. More particularly, this invention relates to engine enrichment apparatus which is thermally responsive and, in some embodiments, also centrifugally responsive.

Centrifugally-responsive compression release apparatus are known for internal combustion engines. A typical centrifugally-responsive compression release apparatus has a curved saddle member that is pivotable on a cam shaft of the engine. At least one flyweight is disposed on an end of the curved saddle. Another portion of the curved saddle has a cam member which, at low engine speeds, is positioned to engage the cam follower of an intake or exhaust valve, and to slightly lift the valve.

The purpose of such prior art compression release mechanisms is to increase engine startability. If one of the engine valves is slightly unseated during engine starting, the compression in the combustion chamber is reduced when the piston moves toward top dead center, thereby decreasing the force applied to the piston surface by the compressed gas in the combustion chamber.

Another purpose of the prior art compression release apparatus is as a secondary enrichening device to enrich the air/fuel mixture during engine starting, in addition to a primary enrichening device such as a primer or choke. These compression release devices enrich the air/fuel mixture only if the intake valve is partially unseated during the compression stroke of the engine. If a typical prior art compression release device is used with the intake valve, the typical air/fuel ratio during engine starting using the compression release is about 10–11:1, but the air/fuel ratio without the compression release engaged is about 11–13:1.

A significant disadvantage of a typical centrifugally-responsive compression release apparatus is that the compression release apparatus is disengaged before the engine is warmed up. The compression release apparatus is disengaged as soon as a predetermined speed of the engine has been reached, which is typically near the engine operating speed. However, the engine operating speed is reached in a few seconds or less after engine starting, long before the engine is warmed up. As soon as the compression release apparatus is disengaged, the enrichening due to the compression release ends, and the air/fuel mixture returns to a leaner ratio of about 11–13:1. If the engine is still cold, this leaning of the air/fuel ratio may cause the engine to stumble or stall.

SUMMARY OF THE INVENTION

An engine enrichening apparatus is disclosed which is thermally-responsive, and which may also be centrifugally responsive in some embodiments. The enrichening apparatus is operable until the engine has warmed up, thereby enrichening the air/fuel ratio to promote startability and engine running during warm-up without stumbling or stalling. If the engine is cold, the enrichening apparatus according to the present invention will operate for about 10 seconds to 5 minutes after engine starting, depending upon the ambient temperature and the amount of enrichening provided.

The enrichening apparatus operates by using a flow pulse to cause an additional flow of gas through the intake manifold past the carburetor fuel nozzle. As a result, additional fuel is discharged through the nozzle during engine warmup to enrich the air/fuel mixture.

In its broadest form, the enrichment apparatus of the present invention comprises a flow passageway between either the crankcase or the engine cylinder on the one hand and an intake passageway (e.g. the intake manifold or the carburetor throat) through which the intake air or intake air/fuel mixture passes, and a thermally-responsive device that allows an enrichening flow pulse (comprised of, for example a portion of the air/fuel mixture, exhaust gases or crankcase gases) to pass through the flow passageway during at least one of the engine strokes in which there is a positive pressure in the engine cylinder (the compression, expansion and exhaust strokes) until the engine has warmed up. The thermally responsive device also enables the flow passageway to close at engine operating temperatures to substantially prevent any enrichening flow pulse from the crankcase or the cylinder to be fed to the intake passageway through the flow passageway during an engine exhaust or compression stroke after the engine has reached operating temperatures.

Several embodiments of the enriching apparatus are disclosed herein. In some embodiments, the thermally responsive device includes a thermally-responsive valve or thermal motor valve assembly disposed in a unique flow passageway to control the flow of an enrichening flow pulse through the flow passageway. In other embodiments, the thermally-responsive device operates with a compression release mechanism to at least partially lift the intake valve during the engine exhaust or compression stroke until the engine reaches operating temperatures. In these latter embodiments, the flow passageway includes the open intake valve passageway and the engine intake manifold.

The embodiments of the enrichment apparatus described herein that operate with a compression release mechanism include a compression release member, at least one flyweight that is interconnected with the compression release member, a cam member that opens an intake valve when the cam member is in its engaged position, but that does not affect valve closing when the cam member is in its disengaged position. The apparatus also includes a unique thermally-responsive device for positioning the cam member in the engaged position when the temperature of the engine is below a predetermined level.

In one embodiment, the compression release member is shaped like a saddle which at least partially surrounds the cam shaft and is pivotally connected to the cam shaft.

In some embodiments, the thermally-responsive means according to the present invention include an arm, preferably made from a thermal actuating polymer or a wax actuator, that engages the cam member when the engine temperature is below the predetermined level so that the cam member is in its engaged position to partially unseat the engine intake valve. When the engine temperature is above the predetermined cut-off level, the arm moves out of the way so that the cam member may be moved to its disengaged position in response to centrifugal force. In an alternate embodiment, the arm engages a flyweight to position the cam member in the engaged position when the engine temperature is below the predetermined level. In either embodiment, the arm is made from a material having either a high coefficient of thermal expansion or a high coefficient of thermal contraction.

In several other embodiments of the present invention, the thermally-responsive device includes a piston which either has a high coefficient of thermal expansion or which is moved by an expanding member having a high coefficient of thermal expansion. In either case, the piston has a piston end that is moved in response to a temperature change, to thereby cause the cam member to be positioned in its engaged position when the engine temperature is below the predetermined level, and to cause the cam member to be in the disengaged position when the engine temperature is above the predetermined level.

In an alternate embodiment, the thermally responsive device includes an elongated member having either a high coefficient of thermal expansion or contraction, with one end affixed to the arm such that the elongated member moves the arm in response to an engine temperature change to substantially disengage the arm from the cam member. In one embodiment, the elongated member comprises a wire made from a shape memory alloy such as a nickel-titanium alloy.

In several embodiments, the thermally-responsive device opens a flow passageway from the engine cylinder to the intake manifold during the compression stroke at engine starting and warmup to enable some of the air/fuel mixture to enter the intake manifold. As a result, additional fuel is discharged through the carburetor fuel nozzle to enrich the air/fuel mixture.

In each of the embodiments of the present invention, the flow pulse applied to the intake passageway during an engine stroke in which there is a positive pressure in the engine cylinder creates a reverse flow through the carburetor venturi and reduces the pressure in the venturi. As a result, the pressure differential between the carburetor fuel bowl pressure and the pressure in the intake passageway (i.e. in the venturi) is increased, thereby causing an amount of fuel to be discharged through the carburetor fuel nozzle at a time when there would otherwise be no fuel delivery in the absence of the flow pulse.

An important feature and advantage of the present invention is that the present invention enriches the air/fuel mixture during start-up as well as during engine warm-up. As a result, the likelihood that the engine will stumble or stall before it is warmed up is substantially reduced.

The present invention may eliminate the need for a fuel primer or a choke during engine warmup, most of which require manual operation, since the present invention automatically enriches the air/fuel ratio during engine warmup. The cost of a primer or choke may then be avoided.

These and other features and advantages of the present invention will be apparent to those skilled in the art from the following detailed description of the preferred embodiments and the drawings. in which:

BRIEF DESCRIPTION OF THE DRAWINGS

FIG. 1 is a perspective view of a typical prior art compression release mechanism.

FIG. 2 is an end view of a first embodiment of the present invention having both thermally-responsive and centrifugally-responsive mechanisms, shown in the engaged position.

FIG. 3 is a side cross sectional view of the first embodiment in the engaged position, taken along line 3—3 of FIG. 2.

FIG. 4 is a side view of a second embodiment having both thermally-responsive and centrifugally-responsive mechanisms, shown in the engaged position.

FIG. 5 is an end view of the second embodiment, shown in the engaged position.

FIG. 6 is an end view of the third embodiment of the present invention having both thermally-responsive and centrifugally-responsive mechanisms.

FIG. 7 is an end view of a fourth embodiment of the present invention having both thermally-responsive and centrifugally-responsive mechanisms.

FIG. 12 is a top view of a cam shaft assembly incorporating the compression release apparatus.

FIG. 13 is a side view of the cam shaft assembly in FIG. 12.

FIG. 14 is an exploded side view of a portion of the compression release assembly in FIG. 13.

FIG. 15 is a side cross sectional view of an engine incorporating the seventh embodiment.

FIG. 16 is an exploded side view of a thermally-responsive valve in the open position used in the seventh embodiment.

FIG. 17 is an exploded side view of the thermally-responsive valve in the closed position.

FIG. 18 is a side cross sectional view of an engine incorporating the thermal motor.

FIG. 19 is an exploded side view of the thermal motor in the open position.

FIG. 20 is an exploded side view of the thermal motor in the closed position.

DETAILED DESCRIPTION OF THE INVENTION

Figure 8:
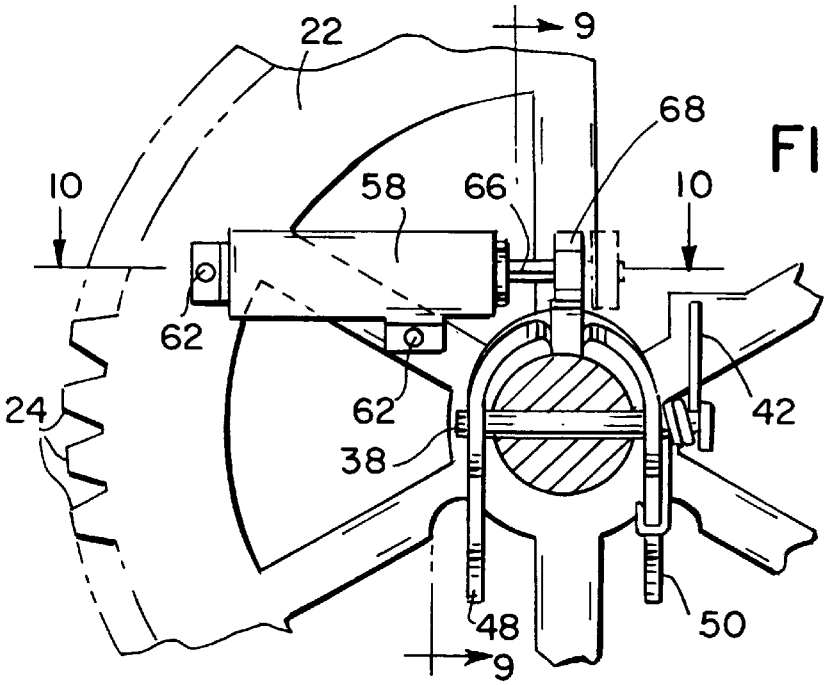
FIG. 8 is an end view of a fifth embodiment of the present invention having both thermally-responsive and centrifugally-responsive mechanisms.

FIG. 1 is a perspective view of a typical prior art centrifugally-responsive compression release mechanism. In FIG. 1, a semi-cylindrical saddle member 10 is pivotally attached to an engine cam shaft 12 at two pivot points 14 and 16. A cam or lift member 18 engages the cam follower surface of a valve assembly. One or more flyweights 20 are affixed to respective ends of saddle member 10.

The prior art centrifugally-responsive compression release mechanism operates in the following manner. When the engine is being started, cam shaft 12 rotates. When the speed of rotation is below a predetermined level, as during engine starting, a return spring causes saddle member 10 to pivot, thereby placing cam or lift member 18 into engagement with the cam follower surface of the valve assembly.

As a result, the valve is lifted off of its seat, thereby reducing the compression in the combustion chamber and aiding startability. Once the engine is started, the speed of cam shaft rotation exerts a centrifugal force on flyweights 20, thereby pivoting saddle member 10 such that cam member 18 disengages from the cam follower, and allows the valve to seat properly. As a result, compression is no longer released in the combustion chamber, and the valve closes normally.

Several embodiments of the present invention comprise an enrichment apparatus that is both thermally and centrifugally responsive. A key advantage of the enrichment apparatus according to the present invention over the prior art compression release apparatus is that the present enrichment apparatus is operable for a longer period of time, until the engine has warmed up. As a result, the air/fuel mixture is enrichened during engine starting as well as during engine warm-up, thereby reducing the likelihood that the engine will stumble or stall during warm-up. Also, the enrichment apparatus according to the present invention only operates for a short period of time, or not at all, during hot restarts of the engine. If the enrichment apparatus was engaged for an extended period of time during hot engine restarts, the air/fuel mixture may be unduly enrichened during hot restart, potentially resulting in poor starting or poor acceleration. Also, unburned fuel may be exhausted to the atmosphere, thereby increasing air pollution.

FIGS. 2 and 3 depict a first embodiment of the present invention, in which the enrichment apparatus is in the engaged position, with the disengaged position depicted in the phantom lines.

In FIGS. 2 and 3, cam gear 22 has a plurality of teeth 24 which engage corresponding teeth on an engine crankshaft (not shown). Cam shaft 26 is interconnected with cam gear 22 and is rotatable therewith.

Affixed to cam shaft 26 are cam lobes 28 and 30, which engage respective cam followers 32 and 34 of two engine valve operating assemblies. Cam follower 32 is a part of the intake valve assembly, and cam follower 34 is a part of the exhaust valve assembly. The lifting of cam follower 32 by cam lobe 28 causes the intake valve (not shown) to be unseated from its valve seat.

The enrichment apparatus of the first embodiment includes a curved saddle member 36 that is pivotable on cam shaft 26 by a pivot pin 38 disposed through the cam shaft. A cam or lift member 40 is affixed to saddle member 36, and engages cam follower 32 when the engine is being started and when the temperature is below a predetermined level. The predetermined temperature level is selected to be between about 100 to 180 degrees Fahrenheit. At lower engine temperatures, lift member 40 lifts cam follower 32, thereby lifting its associated valve off of its valve seat. A spring 42 (FIG. 2) also helps retain cam member 40 in the engaged position during engine starting and during hot restarts of the engine.

A key feature of the present invention is that the enrichment apparatus is automatic and is thermally-responsive. In FIGS. 2 and 3, a thermally-responsive arm 44 engages saddle member 36 or cam member 40 at a surface 46 to keep saddle member 36 and cam member 40 in the engaged position when the engine temperature is below the predetermined level. Arm 44 is preferably made from a thermal actuating material having a shape memory or from a bimetallic material, that is designed to move from the engaged position to the non-engaged position (shown in phantom in FIG. 2) when the engine temperature reaches the predetermined level. A thermal actuating material is available from Hoechst Celanese Corporation of Summit, New Jersey and is sold under the trade name HOECHST ACTUATING POLYMERS. The thermal actuating material has a high coefficient of thermal expansion, and may be designed to actuate at a selected temperature of between about 150 to 280 degrees Fahrenheit. This material has a volume expansion on the order of 14 to 15 percent at a selected temperature. Additional specifications for this material are disclosed in a publication called "Hoechst Actuating Polymers-Material Performance Data", published by Hoechst Celanese at least as early as April, 1996, which is incorporated by reference herein.

As well known in the art, a suitable bimetallic material has two different metals bonded together, with one metal having a higher coefficient of thermal expansion than the other metal.

Other polymers which expand at a temperature that may be suitable for use with the invention are described in a paper by Jang, B. Z. and Zhang, Z. J. entitled "Thermally- and Phase Transformation-Induced Volume Changes of Polymers for Actuator Applications," published in the *Proceedings of the Second International Conference on Intelligent Materials,* Technomic Publishing Co., Inc., June 1994, pages 654–664, and incorporated by reference herein. Table 2 in this paper lists the following polymers which expand 10–20% in volume during melting at a temperature between 150–280° Fahrenheit:

| Polymer | Melting Temperature |
|---|---|
| polyethylene oxide | 153 |
| polybutene | 261 |
| polyethylene | 278 |

Yet another suitable thermally-responsive device is a wax actuator commercially available from Caltherm Corporation of Bloomfield Hills, Mich., Standard-Thompson of Waltham, Mass., and from Robertshaw Company sold under the trademark POWER PILL. U.S. Pat. No. 5,025,627 issued Jun. 25, 1991, U.S. Pat. No. 5,177,969 issued Jan. 12, 1993, and U.S. Pat. No. 5,419,133 issued May 30, 1995 all describe wax-filled actuators which may be used with the present invention.

As best shown in FIG. 2, when the predetermined temperature has been reached, arm 44 is substantially disengaged from saddle member 36, thereby allowing the centrifugal force on flyweights 48 and 50 to pivot saddle member 36 about pivot pin 38, and thereby move cam member 40 so that the cam member substantially disengages from cam follower 32. Arm 44 is affixed to and supported by a support member 52, which in turn is interconnected with cam gear 22.

During hot restarts of the engine, arm 44 will be substantially disengaged from saddle member 36 after a short time, thereby allowing the centrifugal force to pull flyweights 48 and 50 in a direction away from cam shaft 26. As a result, cam member 40 does not engage cam follower 32 after the engine has reached its operating speed.

FIGS. 4 and 5 depict a second embodiment of the present invention. In FIGS. 4 and 5, as in all the figures, corresponding components have been given the same part designations.

The second embodiment of FIGS. 4 and 5 differs from the first embodiment in that thermally-responsive arm 52 engages flyweight 48 at low engine temperatures to position cam member 40 in the engaged position. As shown in phantom in FIG. 5, arm 52 moves out of the way and is disengaged from flyweight 48 when the engine temperature is above the predetermined level, thereby allowing centrifugal force on the flyweights to cause saddle member 36 to pivot so that cam member 40 becomes disengaged from the valve's cam follower.

FIG. 6 depicts a third embodiment of the present invention in which a thermally-responsive elongated member or wire 54 is used to move arm 56. Elongated member 54 is preferably made from an alloy of about 50% nickel and about 50% titanium, and is sold under the trademark FLEXINOL by Dynalloy, Inc. of Irvine, Calif. FLEXINOL actuator wires are small diameter wires which undergo a transformation from martensite to austenite at the selected temperature. Martensite has a coefficient of thermal expansion on the order of $3.67\times10^{-6}$/°F., and austenite has a coefficient of thermal expansion on the order of $6.11\times10^{-6}$/°F. FLEXINOL wires contract when heated to the preselected temperature. At a right angle pull, similar to that depicted in FIGS. 6 and 7, elongated member 54 has a stroke of approximately 14% at the predetermined temperature. Additional properties of FLEXINOL wires are disclosed in a publication by Dynalloy, Inc. entitled "Technical Characteristics of FLEXINOL", published at least as early as 1995 and incorporated by reference herein.

The fourth embodiment of FIG. 7 is similar to the third embodiment of FIG. 6, except that arm 56 engages saddle member 36 or cam member 40 when the arm is in the engaged position, instead of engaging flyweight 48 as in the third embodiment of FIG. 6. When the predetermined engine temperature is reached, elongated member 54 contracts to the position shown in phantom in FIG. 7, thereby allowing the cam member to move to the disengaged position in response to centrifugal force on flyweights 48 and 50.

Figure 9:
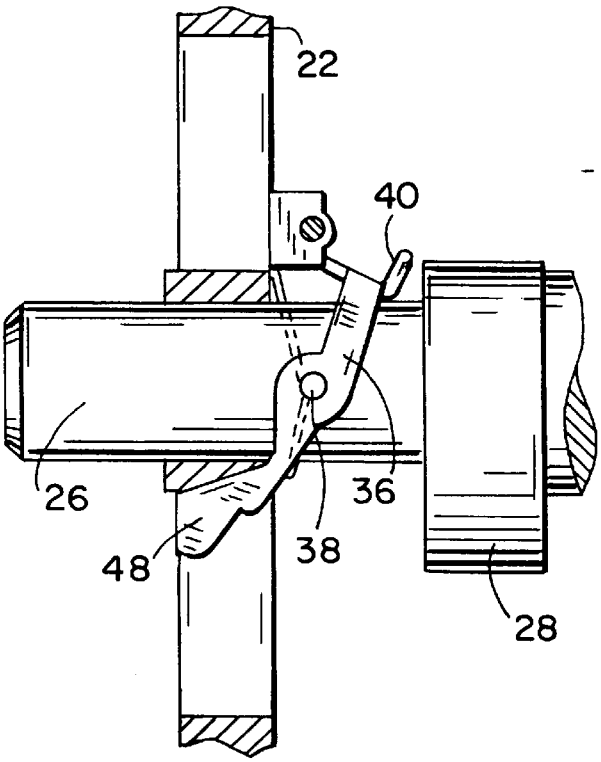
FIG. 9 is a side view of the fifth embodiment, taken along line 9—9 of FIG. 8.

FIGS. 8 and 9 depict a fifth embodiment of the present invention. In the fifth embodiment, the thermally-responsive apparatus includes a housing 58 having a chamber 60 (FIGS. 10 and 11) therein. Housing 58 is affixed to cam gear 22 at two points 62 (FIG. 8).

Figure 10:
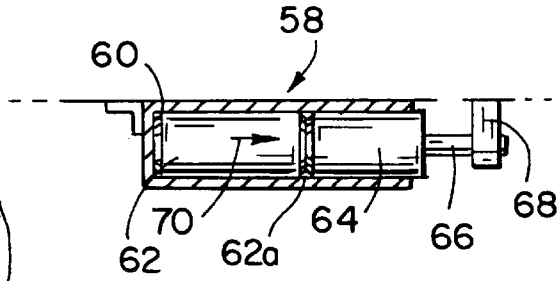
FIG. 10 is a side cross sectional view of the fifth embodiment, taken along line 10—10 of FIG. 8.
Figure 11:
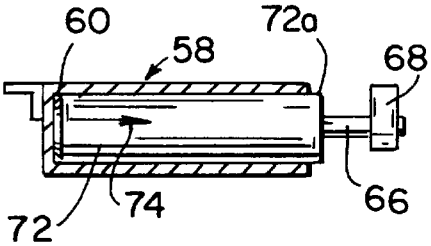
FIG. 11 is a side view of an alternate housing-piston assembly which may be used in the fifth embodiment.

FIGS. 10 and 11 depict two alternate embodiments of the housing assembly which may be used in the fifth embodiment. In FIG. 10, an expansion member 62 is disposed adjacent to a piston 64 within chamber 60. The expansion member is made from a material having a high coefficient of thermal expansion, such as the thermal actuating polymer discussed above. Commercial waxes having a high coefficient of thermal expansion may also be used. Piston 60 in FIG. 10 may be made from metal, plastic, ceramic or another material, and need not have a high coefficient of thermal expansion. Piston 60 is attached by a link 66 to a blocking member 68.

When the assembly of FIG. 10 is used, the increase in engine temperature above the predetermined level causes expansion member 62 to expand, thereby moving end 62*a* of expansion member 62 in the direction indicated by arrow 70. As a result, piston 64 also moves in the direction indicated by arrow 70, causing blocking member 68 to move in a similar direction. Blocking member 68 then moves from the engaged position depicted in solid lines in FIG. 8, to the disengaged position depicted in the phantom lines in FIG. 8. When blocking member 68 is in the engaged position, as best shown FIG. 9, cam member 40 will engage the valve cam follower, thereby partially unseating the associated valve. When blocking member 68 moves to the position depicted in phantom in FIG. 8, the blocking member is substantially disengaged from cam member 40, thereby allowing centrifugal force acting on flyweights 48 and 50 to pivot saddle member 38 and move cam member 40 to its disengaged position.

FIG. 11 depicts an alternate version of a housing-piston assembly which may be used with the fifth embodiment. In FIG. 11, chamber 60 of housing 58 includes a piston 72, preferably made from the thermal actuating polymer discussed above. When the predetermined engine temperature is reached, piston 72 expands in a direction indicated by arrow 74, such that piston end 72*a* is moved in the direction indicated by arrow 74. As a result, blocking member 68 is moved to the disengaged position as discussed above.

In yet another version, housing 58 of FIG. 11 may be eliminated altogether and piston 72 may be replaced by an elongated expansion member that is directly affixed to cam gear 22. The piston may be made from the thermal actuating polymer, or from another material having a high coefficient of thermal expansion. In response to a rise in the engine temperature above the predetermined level, the expansion member would expand in all directions, and would expand sufficiently in a direction indicated by arrow 74 (FIG. 11) to move an attached link 66 and a blocking member 68. The blocking member would then move to the disengaged position.

It will be apparent to those skilled in the art that materials having a high coefficient of thermal contraction may be used in place of the materials having a high coefficient of thermal expansion, with slight modifications to the thermally-responsive assemblies.

The embodiments of the invention discussed above all disclose an enrichment apparatus which is both thermally-responsive and centrifugally-responsive. However, in its broadest form, the present invention is not limited to enrichening apparatus which is centrifugally-responsive. The present invention includes thermally-responsive enrichening apparatus which enriches the air/fuel ratio during engine warmup by using a pressure pulse to cause an additional flow of gas through the engine intake passageway (either the intake manifold or the carburetor throat) past the carburetor fuel nozzle, thereby resulting in additional fuel being discharged through the nozzle to enrich the air/fuel mixture.

In the embodiments discussed above, the pressure pulse proceeds through a flow passageway between the engine cylinder and the intake manifold, through the intake valve port, when the intake valve is partially unseated during the engine compression stroke. Although a centrifugally-responsive compression release mechanism may be used to create this flow passageway for the passage of the flow pulse from the combustion chamber to the intake manifold and past the carburetor fuel nozzle, there is no requirement that the compression release mechanism be centrifugally-responsive as well as thermally-responsive.

Figure 12:
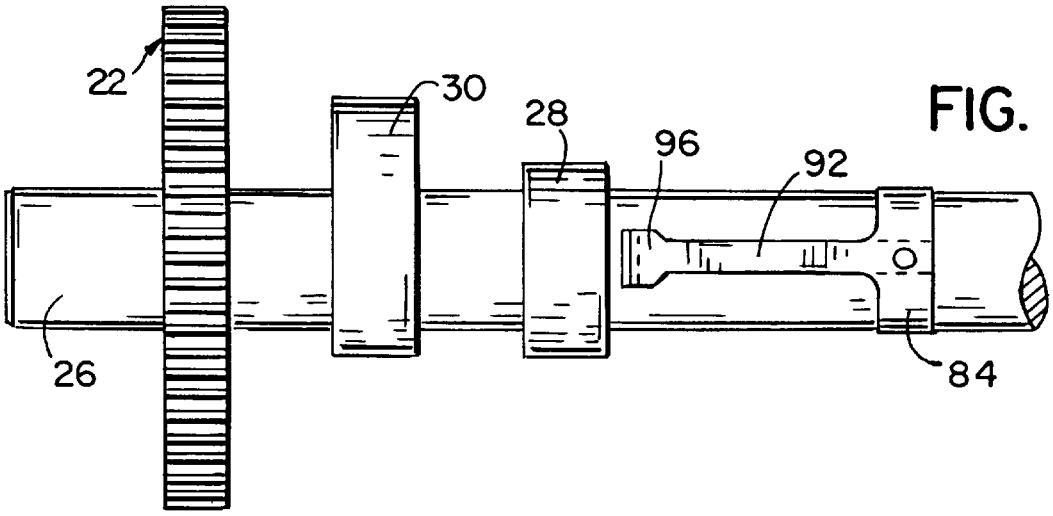
FIGS. 12 through 14 depict a sixth embodiment of the invention using a thermally-responsive compression release mechanism.
Figure 14:
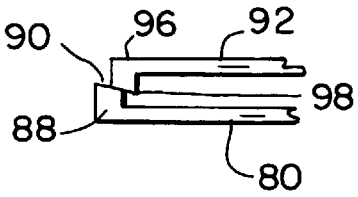
Figure 13:
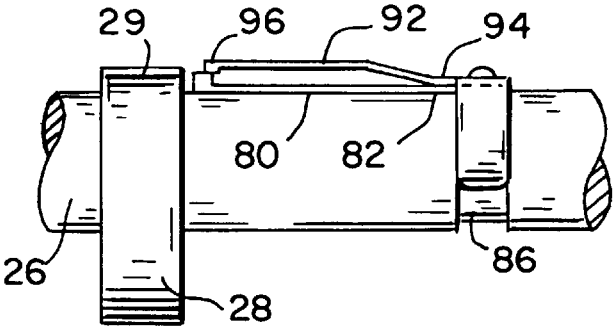

FIGS. 12 through 14 depict a thermally-responsive compressor release apparatus that may be used in the enrichment apparatus of the present invention, but which is not also centrifugally-responsive.

In FIGS. 12 through 14, an elongated thermally-responsive base member 80 has an end 82 attached to a clamp 84, which in turn fits in recess 86 in cam shaft 26. As best shown in FIG. 13, base member 80 may lie substantially adjacent to the outer surface of the cam shaft parallel to the longitudinal axis of the cam shaft, although other configurations are possible.

As best shown at FIG. 14, base member 80 has an end 88 that preferably includes an angled bearing surface 90 that is adjacent to, but not higher than, surface 29 opposite to cam 28.

An elongated member 92 is disposed adjacent to base member 80, and has an end 94 that is also affixed to clamp 84. Member 92 ha opposite end 96 (FIG. 14) having an angled bearing surface 98 that corresponds in shape to angled bearing surface 90 of base member 80. Thermally-responsive member 80 is made from a material having either a high coefficient of thermal expansion or a high coefficient of thermal contraction, such as one of the thermal actuating materials discussed above.

In the embodiment depicted in FIGS. 12 through 14, end 96 is disposed substantially adjacent and above end 88 at engine startup and warmup temperatures. As the engine begins to reach operating temperatures, thermally-responsive base member 80 begins to expand in the longitudinal direction, thereby gradually reducing the overall height of end 96 with respect to the cam shaft. At engine startup and warmup temperatures, the height of end 96 and member 92 is sufficient to partially raise the valve tappet which operates the intake valve during a positive pressure stroke of the engine, thereby creating a flow passageway between the combustion chamber and the intake manifold through the intake port. As the engine temperature reaches operating temperatures, the expansion of base member 80 reduces the overall height of end 96 and base member 80, thereby decreasing the amount which the intake valve is partially raised during a positive pressure stroke. When the engine has reached engine operating temperatures, thermally-responsive member 80 has expanded sufficiently so that the overall height of end 96 and end 88 of base member 80 is below the height of surface 29 (FIG. 13), thereby allowing the intake valve to totally seat during an engine positive pressure stroke.

FIGS. 15 through 20 depict other embodiments of the enrichment apparatus according to the present invention that partially relieve compression in the engine combustion chamber during an engine positive pressure stroke at engine starting and warmup temperatures. As a result, a flow passageway is created between the engine cylinder and the intake manifold. Unlike the other embodiments discussed above, the embodiments in FIGS. 15 though 20 relieve compression not by partially unseating the intake valve but by opening a specially formed flow passageway between the engine cylinder and the intake manifold.

Figure 15:
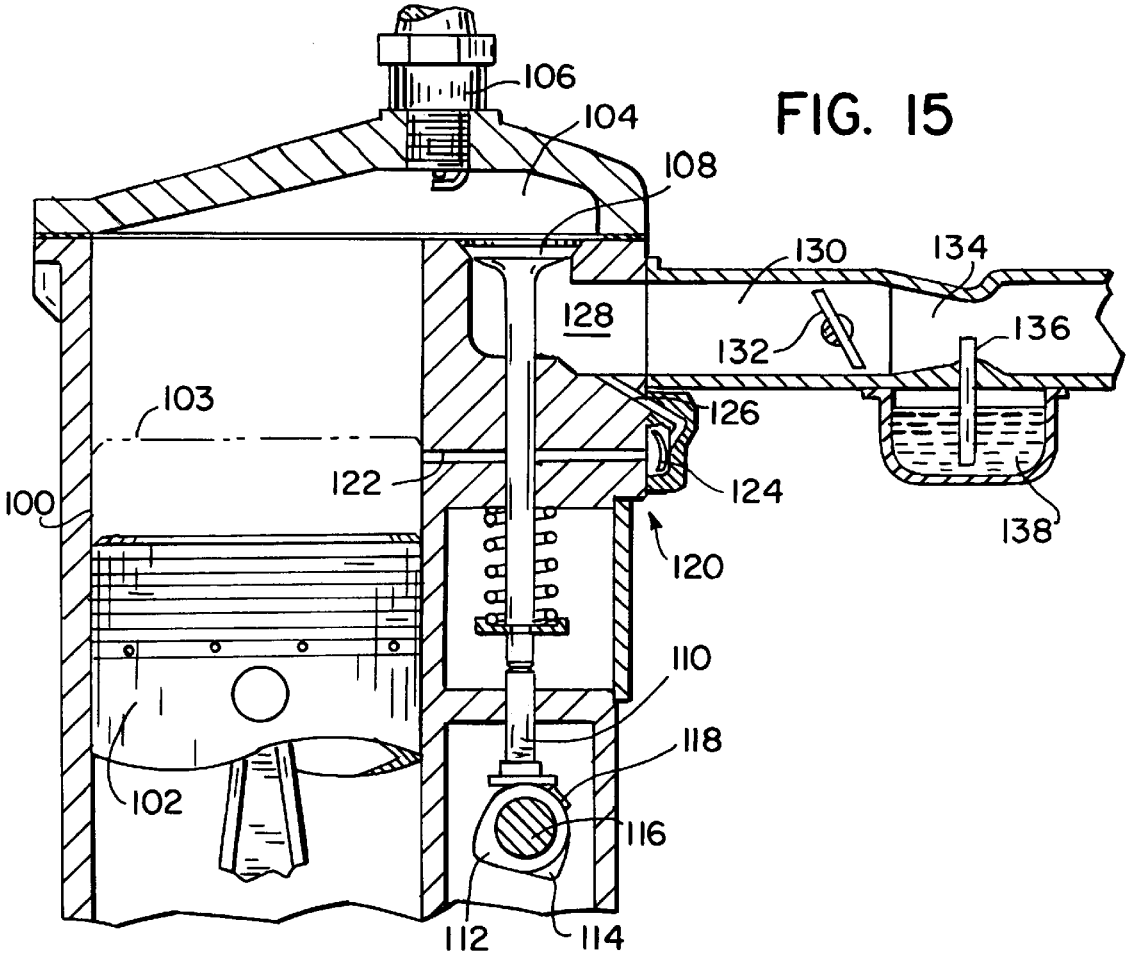
FIGS. 15 through 17 depict a seventh embodiment of the invention have a passageway from the engine cylinder to the intake manifold.
Figure 17:
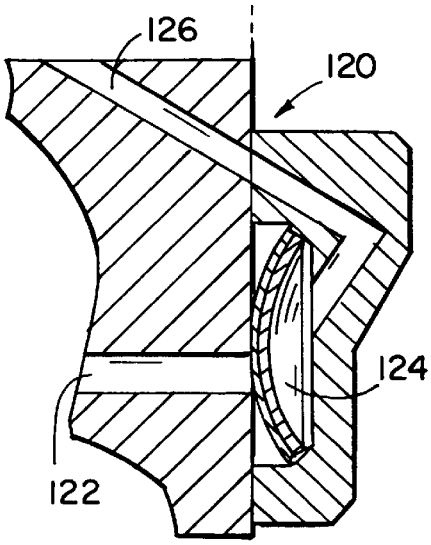
Figure 16:
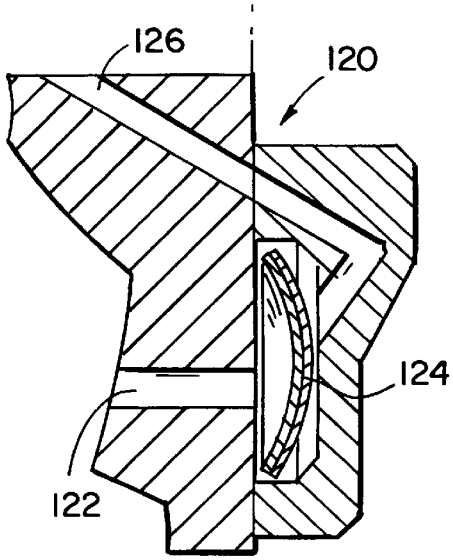
Figure 18:
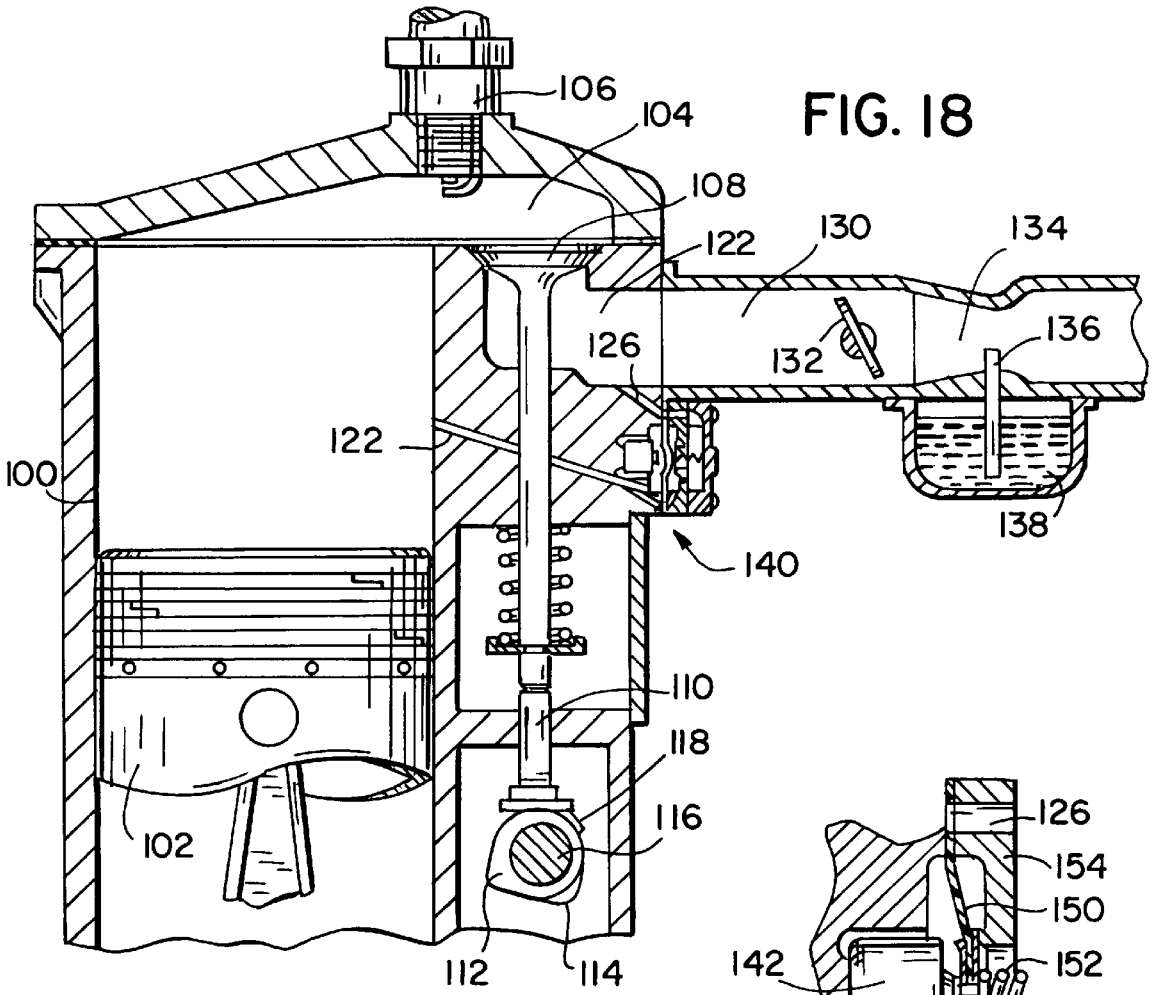
FIGS. 18 through 20 depict the seventh embodiment using an alternate thermally-responsive thermal motor as the valve.
Figure 19:
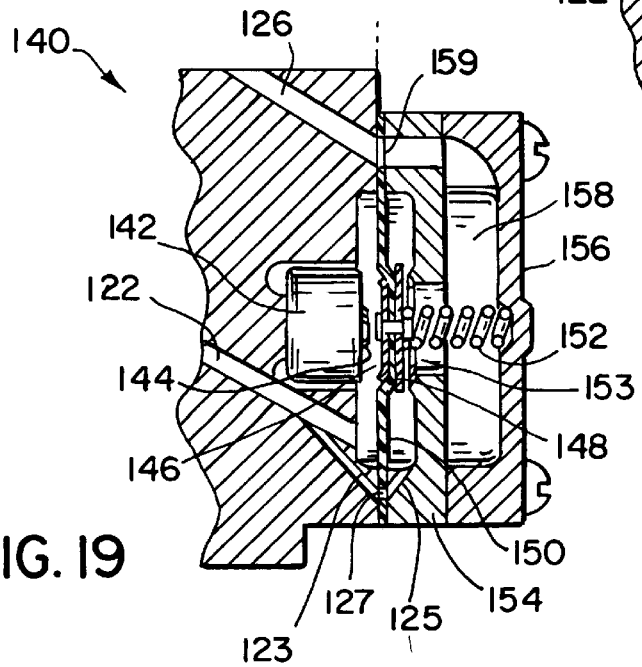

The embodiment of FIGS. 15 through 17 depicts a bimetallic disk as the thermally-responsive member for opening and closing the flow passageway. The embodiment of FIGS. 18 through 19 depicts a thermal motor and a diaphragm being used as a thermally-responsive device.

Referring to FIGS. 15 through 17, engine cylinder 100 has a piston 102 reciprocating therein in response to crankshaft rotation. Disposed generally above cylinder 100 is a combustion chamber 104 having a spark plug 106 adjacent thereto. An intake valve 108 is opened in response to the movement of a valve tappet 110, which in turn is moved by cams 112 and 114 formed integral with a cam shaft 116. The cam shaft may also include a protrusion or bump 118 that partially unseats intake valve to ease startability with a pull rope.

A flow passageway 120 includes a first passageway 122 between engine cylinder 100 and a thermally-responsive device 124, and a second passageway 126 between thermally-responsive device 124 and intake manifold 128. Instead of passageway 126 being formed between thermally-responsive device 124 and intake manifold 128, passageway 126 could be formed between the thermally responsive device 124 and an engine carburetor throat 130. Engine throat 130 includes a throttle valve 132 and a venturi device 134, as is well known in the art. A fuel nozzle 136 is disposed with one end in venturi 134 and an opposite end in a fuel bowl 138.

As shown in FIG. 17, thermally-responsive device 124—which may comprise a bimetal disk—blocks flow passageway 120 by closing off an end of passageway 122 when the disk reaches a predetermined temperature.

As shown in FIG. 16, bimetal thermal-responsive element 124 opens passageway 120 by allowing fluid flow between passageways 122 and 126 at engine starting and engine warmup temperatures. As a result, some of the compression in cylinder 100 (FIG. 15) is released, and a flow pulse passes through passageway 122 and then through passageway 126 to intake manifold 128. This flow pulse then proceeds upstream through throat 130 and venturi device 134, past fuel nozzle 136. During the next intake stroke of the engine, intake valve 108 is open, and the inrush of air, which now includes the additional flow pulse, picks up additional fuel from fuel nozzle 136 to thereby enrichen the air/fuel mixture at engine starting and engine warmup temperatures.

In the embodiment of FIGS. 15 through 17, the position of piston 102 when the exhaust valve starts to open near the end of the expansion stroke is shown as phantom line 103. It is noted that in this position, passageway 122 is blocked by the piston, and thus a fluid cannot flow through passageways 122 and 126 to intake manifold 128 at this time. However, further along in the expansion stroke, the piston begins to move downward toward the crankcase, so that passageway 122 is opened near the end of the expansion stroke of the engine. At engine starting and warmup temperatures, gases in cylinder 100 may then pass from cylinder 100 into the intake manifold causing enrichment due to the reverse flow, as discussed above.

In each of the embodiments of the present invention, a flow pulse passes from at least one of the engine exhaust manifold, the engine cylinder, and the engine crankcase on the one hand and an intake passageway—either the intake manifold or the carburetor throat—on the other hand at engine starting and engine warmup temperatures, during either the engine compression stroke or the engine exhaust stroke at which time there is a positive pressure in the engine cylinder. Except for embodiments depicted in FIGS. 15–21, the intake valve is at least partially open when the flow pulse is transmitted. In the embodiments of FIGS. 2–14, a flow pulse cannot be transmitted during the power or expansion stroke of the engine because the intake valve is closed at that time. In the embodiments of FIGS. 15 through 20, the flow passageway is positioned such that it is blocked by the piston during the expansion and the exhaust strokes except near the end of the expansion and the start of the exhaust stroke to prevent a substantial amount of exhaust gases from passing to the atmosphere or into the intake manifold. In the embodiment of FIG. 21, the flow pulse may be generated whenever there is a positive pressure in the crankcase, but enrichening will only occur when the intake valve is closed.

Figure 20:
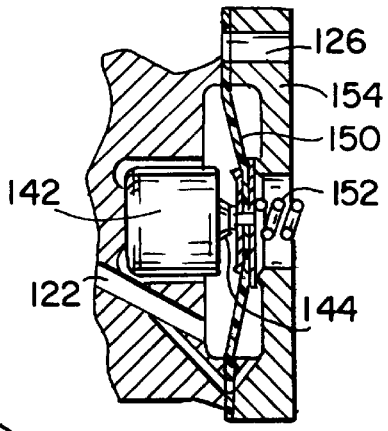
Figure 21:
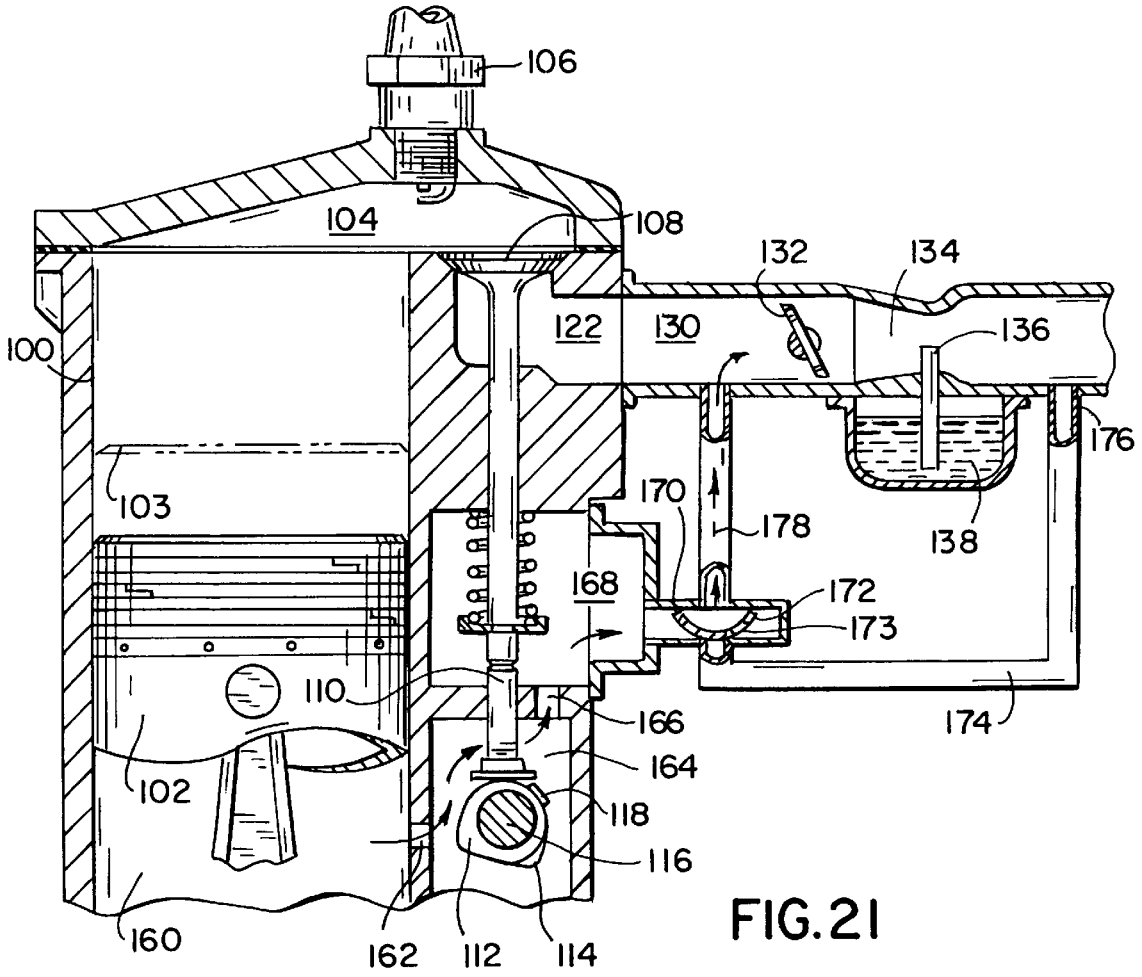
FIG. 21 is a side cross sectional view of an eighth embodiment wherein crankcase flow pulses are provided to the intake manifold during engine warmup.

FIGS. 18 through 20 depict another embodiment of the invention that is similar to the embodiment of FIGS. 15 through 17, except that bimetallic disk valve 124 in FIGS. 15 through 17 has been replaced by a thermal motor assembly 140.

The details of thermal motor assembly 140 are best understood by reference to FIGS. 19 and 20. FIG. 19 depicts the thermal motor valve in the open position, whereas FIG. 20 depicts the thermal motor valve in the closed position. In FIGS. 19 and 20, thermal motor valve assembly 140 includes a thermal motor housing 142 and a plunger 144. Disposed within housing 142 and interconnected with plunger 144 is a thermal actuating material or wax having a high coefficient of thermal expansion, like those discussed above with reference to the other embodiments. Plunger 144 engages a first plate 146 which is fastened to a second plate 148, between which plates is disposed a resilient diaphragm 150. A compression spring 152 biases the diaphragm and plate assembly to an open position. A valve consisting of plates 146 and 148 and diaphragm 150 is seated on a valve seat 154 having an aperture therein to receive spring 152. The entire assembly is held together by a valve cover 156.

The flow pulse discussed above may proceed from the combustion chamber 100 (FIG. 18) to the intake passageway by passing through passageway 122, passageways 123 and 125, and intermediate apertures 127 in diaphragm 150. Gas passes through spring aperture 153, chamber 159 in valve cover 156, through a second aperture 158 in diaphragm 150, and out passageway 126.

When the thermal motor assembly is in the closed position as depicted in FIG. 20, the thermal valve seats on valve seat 154, thereby preventing the gas from passing through passageway 126.

FIG. 21 depicts another embodiment of the present invention, wherein the flow pulses originate from the engine crankcase. At engine starting and warmup temperatures, crankcase gases from crankcase 160 proceed through a flow passageway consisting of aperture 162 in engine cylinder 100, valve operating system chamber 164, aperture 166, chamber 168, past open thermal valve 172, and through passageway 178 to carburetor throat 130 or intake manifold 122 that is downstream of fuel nozzle 136 and venturi 134. As a result, there is an additional reverse fluid flow through venturi 134 and past fuel nozzle 136 that is again drawn forward into the engine combustion chamber 104 through an open intake valve 108 during an engine stroke in which there is a positive pressure in engine crankcase 160. Thermal valve 172 is preferably a bimetallic disk having one or more openings 173 around its circumference, and is shown in the closed position in FIG. 21.

At engine operating temperatures, thermal valve 172 closes off passageway 178, and opens passageway 174 to a point 176 in carburetor throat 130 that is upstream of fuel nozzle 136. As a result, crankcase 160 is internally vented, and no flow pulse enrichening occurs.

While several embodiments of the present invention have been shown and described, alternate embodiments will be apparent to the person skilled in the art and are within the intended scope of the present invention. Therefore, the scope of the present invention is to be limited only by the following claims.

We claim:

1. An enrichment apparatus for a four-stroke internal combustion engine that includes at least one positively pressurized stroke during which there is a positive pressure in an engine cylinder, said engine having a valve operating assembly that operates a valve at engine operating temperatures, having an intake passageway through which an air/fuel mixture passes to an engine cylinder in which a piston reciprocates, and said engine having a cylinder head and crankcase, said apparatus comprising:

a flow passageway between at least one of the crankcase and the cylinder on the one hand and the intake passageway on the other hand; and a thermally-responsive device that allows an enriching flow pulse from at least one of the crankcase and the engine cylinder to pass through said flow passageway during at least one of the positively pressurized strokes until the engine has warmed up to enable the flow pulse originating from at least one of said crankcase and said cylinder to pass through said flow passageway to the intake passageway, and that allows said flow passageway to substantially close at engine operating temperatures during at least one of the engine positively pressurized strokes, said thermally-responsive device including a movable member, distinct from said cylinder head and said valve operating assembly, that changes position near a selected engine operating temperature.

2. The enrichment apparatus of claim 1, wherein said flow passageway includes an engine intake manifold.

3. The enrichment apparatus of claim 1, wherein said flow passageway includes:

a passageway having one end in a combustion chamber of said engine and an opposite end in an engine intake manifold.

4. The enrichment apparatus of claim 1, wherein said thermally-responsive device includes a thermal motor.

5. An enrichment apparatus for an internal combustion engine, said engine having a valve that controls the flow of a gas to or from a combustion chamber of said engine, said enrichment apparatus comprising:

a cam member movable between an engaged position and a disengaged position, that opens said valve when said cam member is in said engaged position;

at least one flyweight that is interconnected with said cam member; and a thermally responsive device that positions said cam member in the engaged position during engine warmup.

6. The enrichment apparatus of claim 5, wherein said engine has a cam shaft, and wherein said enrichment apparatus also includes a compression release member, interconnected with said cam member, that at least partially surrounds said cam shaft and is pivotally connected to said cam shaft.

7. The enrichment apparatus of claim 5, wherein said engine includes a cam gear, and wherein said thermally responsive device is interconnected with said cam gear.

8. The enrichment apparatus of claim 5, wherein said thermally responsive device includes:

an arm that positions said cam member in the engaged position during engine warmup, and that allows said cam member to move to a disengaged position at engine operating temperatures.

9. The enrichment apparatus of claim 8, wherein said arm includes a material having a high coefficient of thermal expansion.

10. The enrichment apparatus of claim 9, wherein said arm includes at least one of a thermal actuating polymer and a wax.

11. The enrichment apparatus of claim 8, wherein said thermally responsive device further comprises:

an elongated member, having one end interconnected with said arm, said elongated member having a high coefficient of thermal expansion.

12. The enrichment apparatus of claim 11, wherein said elongated member comprises a wire made from a shape memory alloy.

13. The enrichment apparatus of claim 8, wherein said arm includes a bimetallic material.

14. The enrichment apparatus of claim 8, wherein said thermally responsive device includes:

an arm that engages said flyweight to position said cam member in the engaged position during engine warmup.

15. The enrichment apparatus of claim 14, wherein said arm includes a material having at least one of a high coefficient of thermal expansion and a high coefficient of thermal contraction.

16. The enrichment apparatus of claim 15, wherein said arm includes at least one of a thermal actuating polymer and a wax.

17. The enrichment apparatus of claim 15, wherein said arm includes a bimetallic material.

18. The enrichment apparatus of claim 8, wherein said thermally responsive device further comprises:

an elongated member, having one end interconnected with said arm, said elongated member having at least one of a high coefficient of thermal expansion and a high coefficient of thermal contraction.

19. The enrichment apparatus of claim 18, wherein said elongated member comprises a wire made from a shape memory alloy.

20. The enrichment apparatus of claim 5, wherein said thermally responsive device includes:

a chamber;

a piston disposed in said chamber that is movable in response to a temperature change; and an expansion member, having a high coefficient of thermal expansion, disposed in said chamber adjacent to said piston;

whereby the expansion of said expansion member moves said piston to thereby position said cam member in a disengaged position at engine operating temperatures.

21. The enrichment apparatus of claim 5, wherein said thermally responsive device also includes:

a chamber; and a piston, disposed in said chamber, that is made from a material having a high coefficient of thermal expansion;

whereby the expansion of said piston causes said cam member to be positioned in a disengaged position at engine operating temperatures.

22. The enrichment apparatus of claim 5, wherein said thermally responsive device includes:

an expansion member, made from a material having a high coefficient of thermal expansion; and a blocking member, interconnected with said expansion member, that positions said cam member in the engaged position during engine warmup.

23. The enrichment apparatus of claim 22, wherein said expansion member includes at least one of a thermal actuating polymer and a wax.

24. The enrichment apparatus of claim 5, wherein said thermally responsive device includes:

a thermally responsive base member, disposed adjacent to said cam shaft, having a first end with a first bearing surface, said thermally responsive member being made from a material that has at least one of a high coefficient of thermal expansion and a high coefficient of thermal contraction; and a second member having a second end with a second bearing surface that corresponds to said first bearing surface.

25. Apparatus that improves the starting and that enriches the air/fuel mixture of an internal combustion engine during engine warmup, said engine having a valve that controls the flow of a gas to or from a combustion chamber and said engine having a cam shaft, comprising:

a compression release member that is pivotally connected to said cam shaft;

a centrifugally-responsive device interconnected with said compression release member;

a lift member, interconnected with said compression release member and movable between an engaged position and a disengaged position, said lift member partially lifting said valve when said lift member is in said engaged position; and a thermally responsive device that positions said lift member in the disengaged position at engine operating temperatures.

26. The apparatus of claim 25, wherein said centrifugally-responsive device includes two flyweights disposed on opposite ends of said compression release member.

27. The apparatus of claim 25, wherein said thermally responsive device includes:

an arm that positions said lift member in the engaged position during engine warmup, and that allows said lift member to move to the disengaged position at engine operating temperatures.

28. The apparatus of claim 27, wherein said arm is made from a material having at least one of a high coefficient of thermal expansion and a high coefficient of thermal contraction.

29. The apparatus of claim 28, wherein said arm includes at least one of a thermal actuating polymer and a wax.

30. The apparatus of claim 27, wherein said arm is made from a bimetallic material.

31. The apparatus of claim 27, wherein said thermally responsive device also includes:

an elongated member, having one end interconnected with said arm, that moves said arm in response to a change in engine temperature.

32. The apparatus of claim 31, wherein said elongated member comprises a wire made from a shape memory alloy.

33. The apparatus of claim 25, wherein said thermally responsive device includes:

an arm that engages said centrifugally-responsive device to position said lift member in the engaged position during engine warmup.

34. The apparatus of claim 33, wherein said arm is made from a material having at least one of a high coefficient of thermal expansion and a high coefficient of thermal contraction.

35. The apparatus of claim 34, wherein said material includes at least one of a thermal actuating polymer and a wax.

36. The apparatus of claim 33, wherein said arm includes a bimetallic material.

37. The apparatus of claim 25, wherein said thermally-responsive device includes:

a chamber; and a piston, at least partially disposed in said chamber, said piston having an end that changes position in response to a change in engine temperature, whereby the position change of said piston end causes said lift member to be positioned in the engaged position during engine warmup.

38. The apparatus of claim 37, further comprising:

an expansion member, having a high coefficient of thermal expansion, disposed in said chamber adjacent to said piston.

39. The apparatus of claim 38, wherein said expansion member includes at least one of a thermal actuating polymer and a wax.

40. The apparatus of claim 25, wherein said thermally-responsive device includes:

an expansion member, made from a material having a high coefficient of thermal expansion; and a blocking member, interconnected with said expansion member, that positions said lift member in the engaged position during engine warmup.

41. The apparatus of claim 40, wherein said expansion member is made from a material including at least one of a thermal actuating polymer and a wax.

42. The apparatus of claim 25, wherein said thermally responsive device includes:

a base member disposed adjacent to said cam shaft, having a first end with a first bearing surface; and a thermally responsive member having a second end with a second bearing surface that corresponds to said first bearing surface, said thermally responsive member being made from a material that has at least one of a high coefficient of thermal expansion and a high coefficient of thermal contraction.

43. An enrichment apparatus for a four-stroke internal combustion engine that includes at least one positively pressurized stroke during which there is a positive pressure in an engine cylinder, said engine having an intake passageway through which an air/fuel mixture passes to an engine cylinder in which a piston reciprocates, and said engine having a crankcase, said apparatus comprising:

a flow passageway between at least one of the crankcase and the cylinder on the one hand and the intake passageway on the other hand;

a thermally-responsive device that allows an enriching flow pulse from at least one of the crankcase and the engine cylinder to pass through said flow passageway during at least one of the positively pressurized strokes until the engine has warmed up to enable the flow pulse originating from at least one of said crankcase and said cylinder to pass through said flow passageway to the intake passageway, and that allows said flow passageway to substantially close at engine operating temperatures during at least one of the engine positively pressurized strokes;

said thermally-responsive device including:

a) a compression release apparatus that, when in an engaged position, at least partially releases compression pressure in a combustion chamber at engine starting speeds; and b) a thermally-responsive member that keeps said compression release apparatus in the engaged position during engine warmup.

44. The enrichment apparatus of claim 43, wherein said compression release apparatus includes:

a cam member, movable between the engaged position and a disengaged position, that causes an engine intake valve to be at least partially open when the cam member is in the engaged position;

at least one flyweight that is interconnected with said cam member;

and wherein said thermally-responsive member includes a member that positions said cam member in the engaged position during engine warmup.

45. The enrichment apparatus of claim 44, wherein said engine has a cam shaft, and wherein said compression release apparatus also includes:

a compression release member, interconnected with said cam member, that at least partially surrounds said cam member and is pivotally connected to said cam shaft.

46. The enrichment apparatus of claim 44, wherein said thermally responsive device includes:

an arm that positions said cam member in the engaged position during engine warmup, and that allows said cam member to move to said disengaged position at engine operating temperatures.

47. The enrichment apparatus of claim 46, wherein said arm includes a material having at least one of a high coefficient of thermal expansion and a high coefficient of thermal contraction.

48. The enrichment apparatus of claim 47, wherein said arm includes at least one of a thermal actuating polymer and a wax.

49. The enrichment apparatus of claim 46, wherein said thermally responsive device further comprises:

an elongated member, having one end interconnected with said arm, said elongated member having at least one of a high coefficient of thermal expansion and a high coefficient of thermal contraction.

50. The enrichment apparatus of claim 49, wherein said elongated member comprises a wire made from a shape memory alloy.

51. The enrichment apparatus of claim 46, wherein said arm includes a bimetallic material.

52. The enrichment apparatus of claim 44, wherein said thermally responsive device includes:

an arm that engages said flyweight to position said cam member in the engaged position during engine warmup.

53. The enrichment apparatus of claim 52, wherein said arm includes a material having at least one of a high coefficient of thermal expansion and a high coefficient of thermal contraction.

54. The enrichment apparatus of claim 53, wherein said arm includes at least one of a thermal actuating polymer and a wax.

55. The enrichment apparatus of claim 53, wherein said arm includes a bimetallic material.

56. The enrichment apparatus of claim 53, wherein said thermally responsive device further comprises:

an elongated member, having one end interconnected with said arm, said elongated member having at least one of a high coefficient of thermal expansion and a high coefficient of thermal contraction.

57. The enrichment apparatus of claim 56, wherein said elongated member comprises a wire made from a shape memory alloy.

58. The enrichment apparatus of claim 44, wherein said thermally responsive device includes:

a chamber;

a piston disposed in said chamber that is movable in response to a temperature change; and an expansion member, having a high coefficient of thermal expansion, disposed in said chamber adjacent to said piston;

whereby the expansion of said expansion member moves said piston to thereby position said cam member in a disengaged position at engine operating temperatures.

59. The enrichment apparatus of claim 44, wherein said thermally responsive device also includes:

a chamber; and a piston, disposed in said chamber, that is made from a material having a high coefficient of thermal expansion;

whereby the expansion of said piston causes said cam member to be positioned in a disengaged position at engine operating temperatures.

60. The enrichment apparatus of claim 44, wherein said thermally responsive device includes:

an expansion member, made from a material having a high coefficient of thermal expansion; and a blocking member, interconnected with said expansion member, that positions said cam member in the engaged position during engine warmup.

61. The enrichment apparatus of claim 60, wherein said expansion member includes at least one of a thermal actuating polymer and a wax.

* * * * *